US008220676B1

(12) United States Patent
Hicks

(10) Patent No.: US 8,220,676 B1
(45) Date of Patent: Jul. 17, 2012

(54) RETRACTABLE TETHER APPARATUS FOR USE WITH CELLULAR TELEPHONES AND ASSOCIATED METHOD

(76) Inventor: Lenora Hicks, Gwynn Oak, MD (US)

( * ) Notice: Subject to any disclaimer, the term of this patent is extended or adjusted under 35 U.S.C. 154(b) by 583 days.

(21) Appl. No.: 12/383,627

(22) Filed: Mar. 27, 2009

Related U.S. Application Data

(60) Provisional application No. 61/070,776, filed on Mar. 27, 2008.

(51) Int. Cl.
*B65H 75/40* (2006.01)
*B65H 75/30* (2006.01)

(52) U.S. Cl. ..... 224/162; 224/929; 224/930; 242/379; 242/385.4

(58) Field of Classification Search ..... 224/162, 224/929, 930, 244, 255, 269, 271, 272, 183, 224/666, 568.2; 340/571, 548, 568.2, 568.1; 150/134, 102; 242/378.3, 402, 379, 580, 242/385.4, 404.3; D10/72; D3/215
See application file for complete search history.

(56) References Cited

U.S. PATENT DOCUMENTS 15,440 A * 7/1856 Ruggles ..... 116/84
3,968,670 A * 7/1976 Quenot ..... 70/456 R
5,396,219 A * 3/1995 Chen ..... 340/571
6,088,021 A 7/2000 Yong
6,616,080 B1 9/2003 Edwards et al.
6,659,382 B2 * 12/2003 Ryczek ..... 242/379
6,731,956 B2 5/2004 Hanna et al.
D498,358 S * 11/2004 Wolff ..... D3/215
7,007,882 B2 * 3/2006 Raia et al. ..... 242/379
7,277,013 B2 * 10/2007 Yen ..... 340/568.7
D573,046 S * 7/2008 Levinson ..... D10/70
2004/0089759 A1 * 5/2004 Genuise ..... 242/379
2007/0051842 A1 * 3/2007 Pryor ..... 242/378.3
2007/0183146 A1 * 8/2007 Swartfager ..... 362/208
2008/0106409 A1 * 5/2008 Schmidt ..... 340/568.1

OTHER PUBLICATIONS www.alternativewireless.com.

* cited by examiner

*Primary Examiner* — Nathan J Newhouse
*Assistant Examiner* — Matthew Theis

(57) ABSTRACT

A retractable tethering apparatus preferably includes a portable housing, a spring-actuated spool positioned within the housing, a flexible cord retractably wound about the spring-actuated spool, and a coupling section secured to a distal end of the cord. Such a coupling section is removably connected to the cellular telephone. Also provided is a mechanism for automatically notifying the user when the coupling section is disengaged from the housing by emitting an alert signal when the cord is unwound from the spring-actuated spool. In this manner, the coupling section may be completely disengaged from the housing when the cord is extracted from the housing.

12 Claims, 4 Drawing Sheets

RETRACTABLE TETHER APPARATUS FOR USE WITH CELLULAR TELEPHONES AND ASSOCIATED METHOD

CROSS REFERENCE TO RELATED APPLICATIONS

This application claims the benefit of U.S. Provisional Application No. 61/070,776, filed Mar. 27, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION TECHNICAL FIELD

This invention relates to tethers and, more particularly, to a retractable bodily worn tether for cellular telephones and the like for providing cell-phone users with a convenient means of ensuring their phone will not fall to the ground should they lose a grip of it during use.

PRIOR ART

The widespread use of cellular phones is a well known fact in today's society. Persons of all ages are known to have cellular phones for a variety of uses. Family members may employ cell-phones as a means to stay in contact with each other throughout the day. In these instances younger children may be limited to only calling when they need to be picked up from school or the like, whereas teenagers may be allowed to call their friends. The elderly may keep a cellular phone on their person to stay in contact with their children, or simply to be able call emergency response personnel as needed. Business people, obviously, use their cellular phones to stay in contact with clients and coworkers.

Almost every cell-phone user can attest to the fact that at one point or another they have lost a grip of their phone during use, causing it to fall to the ground. Such drops can be uneventful, or may result in irreparable damage being inflicted on the cellular phone. In the latter instance, if the person's warranty has expired, they must pay an exorbitant amount of money to replace the damage phone. Obviously, it should be advantageous to provide a means of ensuring a cellular telephone does not fall to the ground when dropped.

Accordingly, a need remains for a retractable bodily worn tether for cellular telephones and the like in order to overcome the above-noted shortcomings. The present invention satisfies such a need by providing an assembly that is convenient and easy to use, is durable yet lightweight in design, is versatile in its applications, and provides users ready access to their cellular phone whenever needed.

BRIEF SUMMARY OF THE INVENTION

In view of the foregoing background, it is therefore an object of the present invention to provide a retractable tethering apparatus for supporting a cellular telephone at an elevated position. These and other objects, features, and advantages of the invention are provided by a retractable tethering apparatus preferably including a portable housing, a spring-actuated spool positioned within the housing, a flexible cord retractably wound about the spring-actuated spool, and a coupling section secured to a distal end of the cord. Such a coupling section is removably connected to the cellular telephone.

The present invention further includes a mechanism for automatically notifying the user when the coupling section is disengaged from the housing by emitting an alert signal when the cord is unwound from the spring-actuated spool. In this manner, the coupling section may be completely disengaged from the housing when the cord is extracted from the housing. In one embodiment, the present invention may further include a resilient belt clip directly attached to an outer surface of the housing for securing the housing to the user.

In one embodiment, the automatic notifying mechanism preferably includes a sensor located within the housing and communicatively mated to the coupling section, a transducer located within the housing and communicatively mated to the sensor, and a power source located within the housing and communicatively mated to the transducer. The sensor preferably generates and transmits first and second output signals to the transducer when the coupling section is detached and attached to the housing respectively. The transducer automatically generates and emits the alert signal upon receiving the first output signal. In this manner, the alert signal may be automatically discontinued when the transducer receives the second output signal.

In one embodiment, the spring-actuated spool may include a spring member statically attached to the spool and helically wound thereabout. Such a spring member may be tensioned to a compressed position as the spool is rotated in a first direction during a cord extraction procedure. The spring member may be automatically returned to an equilibrium position upon completion of the extraction procedure. The spool is caused to automatically rotate along a second direction as the cord is retracted into the housing and wound about the spool.

In one embodiment, the coupling section preferably includes a ring adapted to be directly connected to the cellular telephone, and a bracket adjustably mated directly to the ring. Such a bracket may be adapted to remain spaced from the cellular telephone such that the ring remains freely adjustable with the bracket. In this manner, the bracket is provided with laterally registered ribs linearly extending along opposed faces of the bracket.

In one embodiment, the housing preferably includes a notch formed at a distal end thereof. Such a notch passes from an anterior face of the housing to a posterior face thereof. The bracket may be countersunk within the notch while attached to the housing such that the cord is maintained at a maximum wound position while the bracket is coupled to the housing. The housing may further include a plurality of oppositely spaced rectilinear grooves formed within the notch. Such grooves may extend from the anterior face to the posterior face of the housing respectively. The ribs may be contiguously interfitted within the grooves while the bracket is seated within the notch.

A plurality of opposed recessions are formed along the distal end of the housing. Such recessions laterally extend away from the notch and may be equidistantly offset from a center of the notch for receiving opposed quadrants of the ring. The coupling section is preferably maintained at a substantially stable position while the bracket is countersunk within the notch and the opposed ring quadrants are interfitted within the recessions respectively. In this manner, the ring is prohibited from being displaced along a travel path defined parallel to the grooves while the opposed quadrants are nested within the recessions.

Notably, the sensor is communicatively coupled to the grooves and thereby detects whether the ribs are contiguously positioned within the grooves. Such first and second output signals may be automatically generated when the ribs are removed and positioned within the grooves such that the alert signal is automatically emitted when the bracket becomes detached from the notch.

The present invention further includes a method of utilizing a retractable tethering apparatus for supporting a cellular telephone at an elevated position. In particular, the method preferably includes the chronological steps of: providing a portable housing; providing and positioning a spring-actuated spool section within the housing; providing and retractably winding a flexible cord about the spring-actuated spool; providing and securing a coupling section to a distal end of the cord; connecting the cellular telephone to the coupling section; automatically notifying the user when the coupling section is disengaged from the housing by emitting an alert signal when the cord is unwound from the spring-actuated spool; and maintaining the coupling section completely disengaged from the housing when the cord is extracted from the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
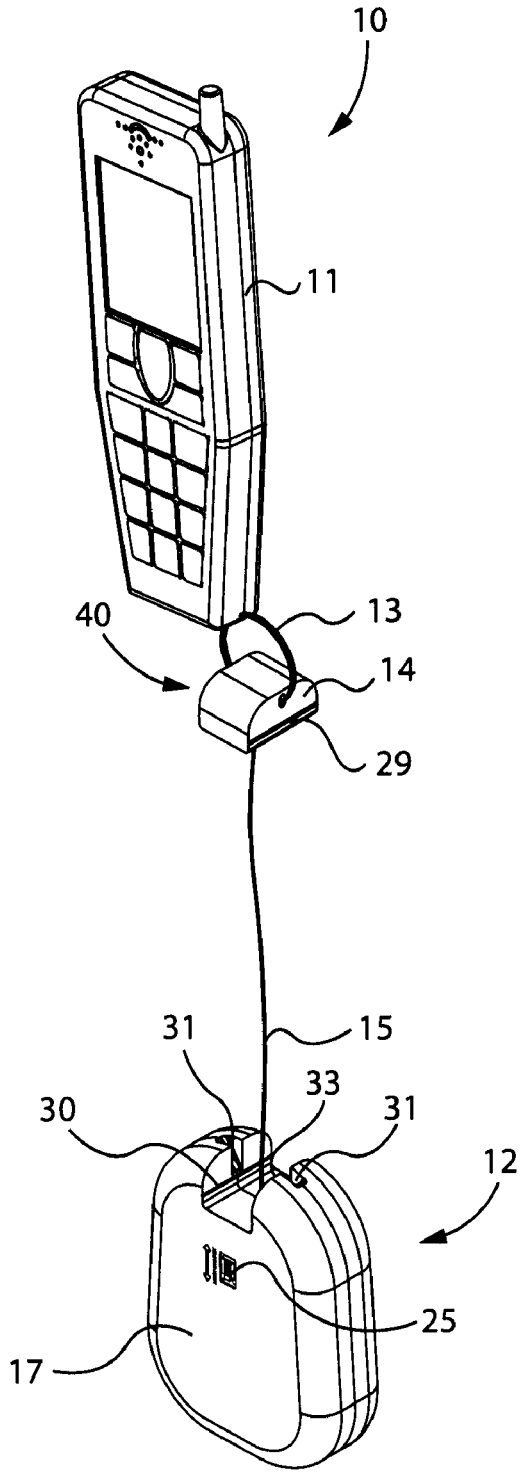
FIG. 1 is an exploded view showing a retractable tethering apparatus attached to a cellular telephone, in accordance with the present invention.
Figure 2:
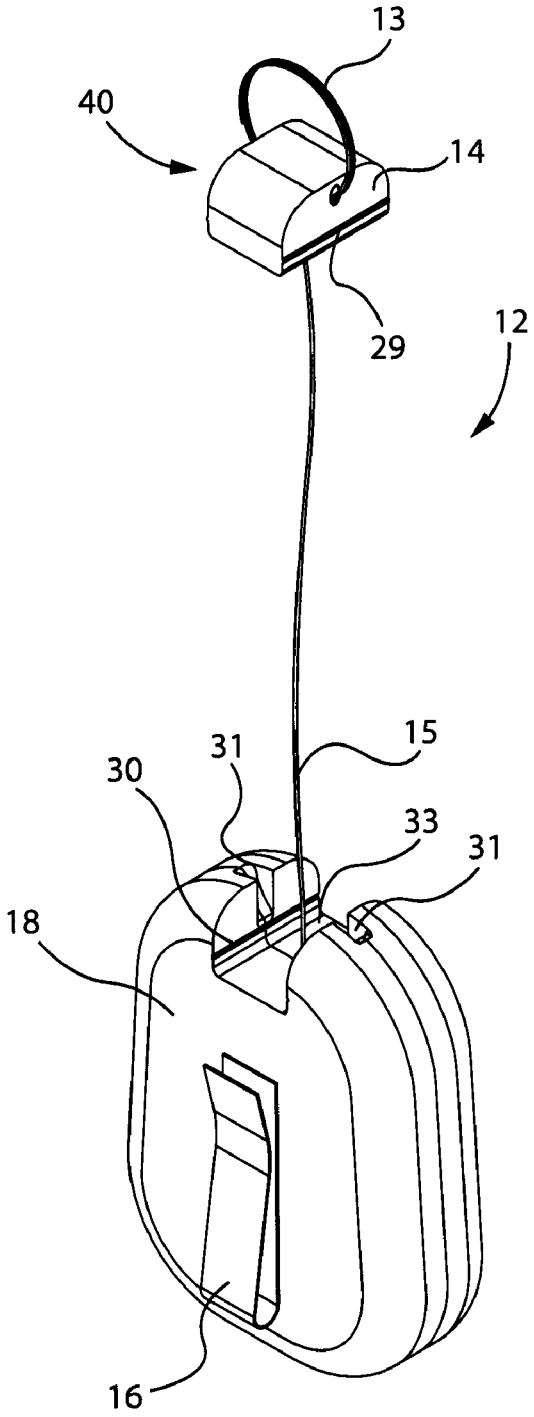
FIG. 2 is an exploded view showing the clamping section detached from the housing when the cord is unwound.
Figure 3:
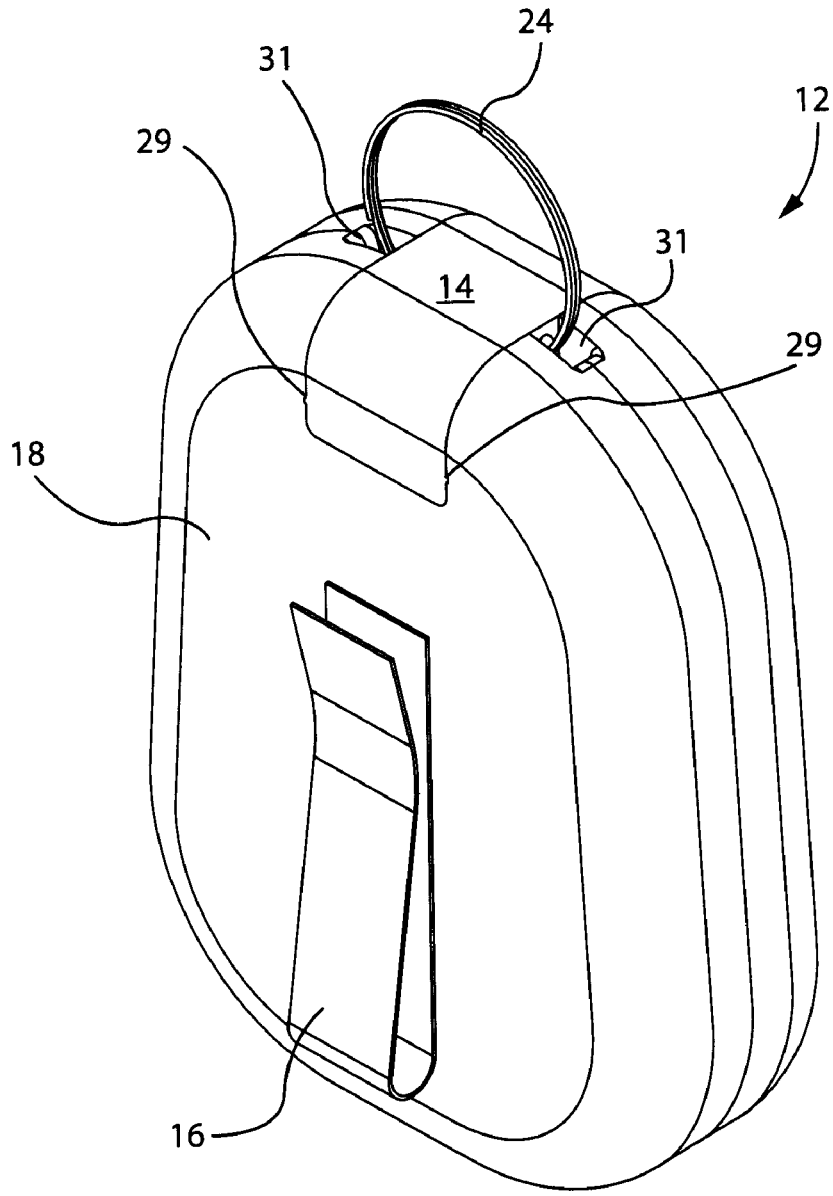
FIG. 3 is perspective view showing the belt clip.

It is noted that the present invention is not drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus 10 of this invention is referred to generally in FIGS. 1-5 by the reference numeral 10 and is intended to provide a retractable tethering apparatus 10 for supporting a telephone 11 during transport. It should be understood that the retractable tethering apparatus 10 may be used to support many different types of portable electronic devices and should not be limited to only cellular telephones 11, for example.

Referring to the FIGS. 1-5 in general, the retractable tethering apparatus 10 preferably includes a portable housing 12, a spring-actuated spool 26 positioned within the housing 12, a flexible cord 15 retractably wound about the spring-actuated spool 26, and a coupling section 40 secured to a distal end of the cord 15. Such a coupling section 40 is removably connected to the cellular telephone 11.

In one embodiment, the present invention 10 may further include a resilient belt clip 16 directly attached to an outer surface of the housing 12 for securing the housing 12 to the user. Since the present invention 10 may be conveniently secured to the person, a purse or other designated object, the present invention 10 spares the cellular subscriber the hassle of digging inside their purse, briefcase or backpack in order to locate their cellular telephone 11. In addition, the present invention 11 proves a valuable safety tool, ensuring that one's cellular telephone 11 would not drop or fall to the ground.

The present invention 11 further includes a mechanism 20 for automatically notifying the user when the coupling section 40 is disengaged from the housing 12 by emitting an alert signal when the cord 15 is unwound from the spring-actuated spool 26. A toggle switch (not shown) may also be provided for temporarily disengaging the automatic notifying mechanism 20 so that an alert signal is not emitted when the user intends to use the cellular telephone 11 to make/take a call. One skilled in the art understands that a toggle switch may take the form of a power interrupt pole switch, which is connected to power source 23 in a conventional manner known in the art. Further, a locking cam 25 is provided to prohibit cord 15 from being extracted from the housing 12. Such a locking cam 25 adjoins the spool 26 and spring 27 and thereby intersects the arcuate path along which the spool 26 rotates. In this manner, when the locking cam 25 is engaged with the spool 26 and spring 27, the apparatus 10 is locked. When the locking cam 25 is released from the spool 26 and spring 27, the cord 15 is caused to automatically retract to a wound position.

During extraction procedures, the coupling section 40 may be completely disengaged from the housing 12 when the cord 15 is extracted from the housing 12. Such a feature provides an unexpected and unpredictable advantage of effectively notifying the user when the cellular telephone 11 is displaced away from the housing 12.

Figure 4:
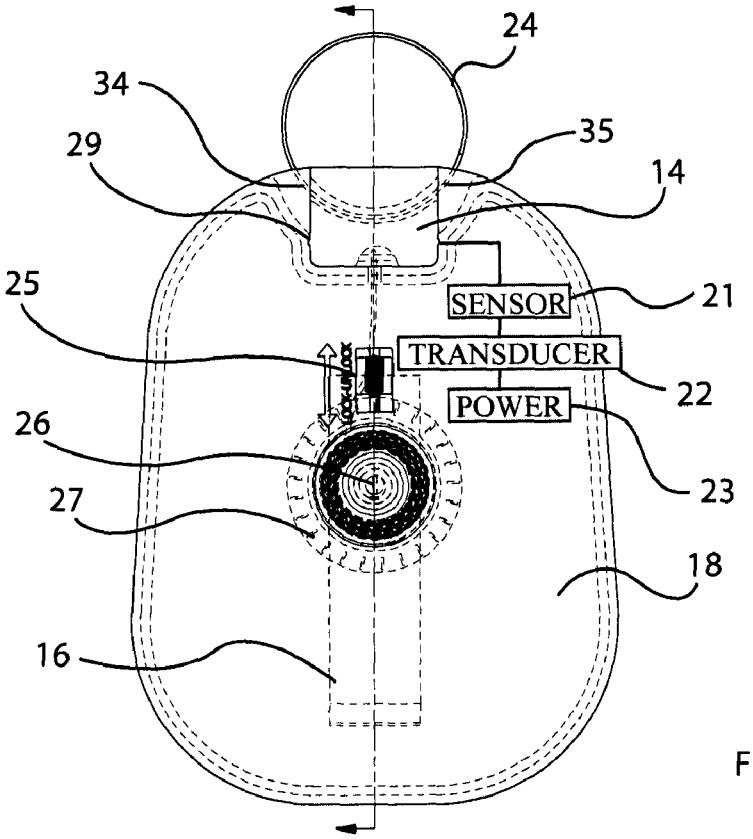
FIG. 4 is a front elevational view showing the spool and automatic notifying mechanisms disposed within the housing.
Figure 5:
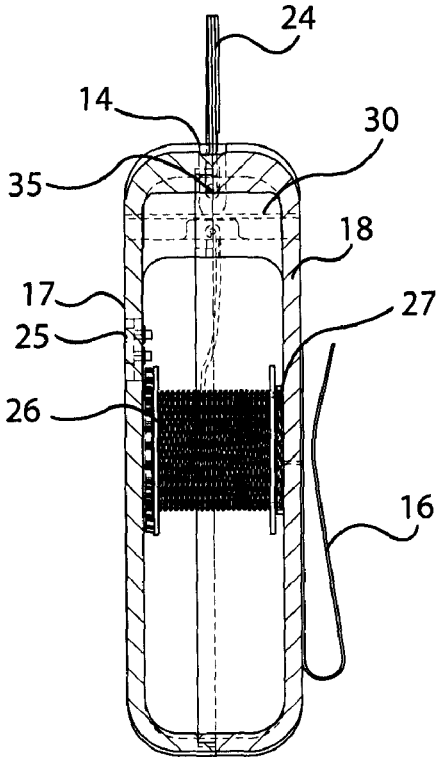
FIG. 5 is a side elevational view of FIG. 4.

In one embodiment, as perhaps best shown in FIG. 4, the automatic notifying mechanism 20 preferably includes a sensor 21 located within the housing 12 and communicatively mated to the coupling section 40. For example, a motion and/or light sensor 21(*s*) may be provided to cause the present invention for detecting an event, for example. Active and/or passive sensors 21 may be used to react to detectable subject matter such as light, noise, radiation (e.g., heat), or changes in emitted energy, fields or beams. However, the invention is not limited to a particular type of sensor. Those skilled in the art will appreciate that other sensors may be used without departing from the scope of the invention. Examples of such other sensors include pressure sensitive mats; optical sensors configured to sense light; microwave sensors that use a Gunn diode operating within pre-set limits to transmit/flood a designated area/zone with an electronic field whereby movement in the zone disturbs the field and sets off an alarm; an ultrasonic sensor configured to react to a determined range of ultrasonic sound energy in a protected area; or any other sensor capable of providing motion detection capability in accordance with principles of the invention.

Still referring to FIG. 4, the automatic notifying mechanism 20 further includes a transducer 22 located within the housing 12 and communicatively mated to the sensor 21. For example, the transducer 22 may include an audio speaker, a light-emitting source, or a mechanical or electro-mechanical device that is capable of generating vibrations.

Still referring to FIG. 4, a power source 23 is located within the housing 12 and communicatively mated to the transducer 22. The power source 23 may include one or more rechargeable or non-rechargeable disposable batteries, photovoltaic cells, and/or an AC adapter or other power supply means.

The sensor 21 preferably generates and transmits first and second output signals to the transducer 22 when the coupling section 40 is detached and attached to the housing 12 respectively. The transducer 22 automatically generates and emits the alert signal upon receiving the first output signal. In this manner, the alert signal may be automatically discontinued when the transducer 22 receives the second output signal.

In one embodiment, the spring-actuated spool 26 may include a spring member 27 statically attached to the spool 26 and helically wound thereabout. Such a spring member 27 may be tensioned to a compressed position as the spool 26 is rotated in a first direction during a cord 15 extraction procedure. The spring member 27 may be automatically returned to an equilibrium position upon completion of the extraction procedure. The spool 26 is caused to automatically rotate along a second direction as the cord 15 is retracted into the housing 12 and wound about the spool 26. Thus, the cellular telephone 11 is prohibited from falling down to a ground surface while the housing 12 is maintained on a user's belt, for example.

In one embodiment, the coupling section 40 preferably includes a ring 24 adapted to be directly connected to the cellular telephone 11, and a bracket 14 adjustably mated directly to the ring 24. Such a bracket 14 may be adapted to remain spaced from the cellular telephone 11 such that the ring 24 remains freely adjustable with the bracket 14. In this manner, the bracket 14 is provided with laterally registered ribs 29 linearly extending along opposed faces of the bracket 14.

In one embodiment, the housing 12 preferably includes a notch 33 formed at a distal end thereof. Such a notch 33 passes from an anterior face 17 of the housing 12 to a posterior face 18 thereof. The bracket 14 may be countersunk within the notch 33 while attached to the housing 12 such that the cord 15 is maintained at a maximum wound position while the bracket 14 is coupled to the housing 12. The housing 12 may further include a plurality of oppositely spaced rectilinear grooves 30 formed within the notch 33. Such grooves 30 may extend from the anterior face 17 to the posterior face 18 of the housing 12 respectively. The ribs 29 may be contiguously interfitted within the grooves 30 while the bracket 14 is seated within the notch 33.

A plurality of opposed recessions 31 are formed along the distal end of the housing 12. Such recessions 31 laterally extend away from the notch 33 and may be equidistantly offset from a center of the notch 33 for receiving opposed quadrants 34, 35 of the ring 24. The coupling section 40 is preferably maintained at a substantially stable position while the bracket 14 is countersunk within the notch 33 and the opposed ring quadrants 34, 35 are interfitted within the recessions 31, respectively. In this manner, the ring 24 is prohibited from being displaced along a travel path defined parallel to the grooves 30 while the opposed quadrants 34, 35 are nested within the recessions 31. The combination of the grooves 30, ribs 29 and recessions 31, provide the unexpected and unpredictable benefit of prohibiting the cord 15 from being extracted unless a minimum external force is axially exerted on the coupling section 40.

Notably, the sensor 21 is communicatively coupled to the grooves 30 and thereby detects whether the ribs 29 are contiguously positioned within the grooves 30. Such first and second output signals may be automatically generated when the ribs 29 are removed and positioned within the grooves 30 such that the alert signal is automatically emitted when the bracket 14 becomes detached from the notch 33. In this manner, the user is able to quickly learn if the clamping section is not securely fastened to the housing 12.

The present invention further includes a method of utilizing a retractable tethering apparatus 10 for supporting a cellular telephone 11 at an elevated position. In particular, the method preferably includes the chronological steps of: providing a portable housing 12; providing and positioning a spring-actuated spool 26 within the housing 12; providing and retractably winding a flexible cord 15 about the spring-actuated spool 26; providing and securing a coupling section 40 to a distal end of the cord 15; connecting the cellular telephone 11 to the coupling section 40; automatically notifying the user when the coupling section 40 is disengaged from the housing 12 by emitting an alert signal when the cord 15 is unwound from the spring-actuated spool 26; and maintaining the coupling section 40 completely disengaged from the housing 12 when the cord 15 is extracted from the housing 12.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A retractable tethering apparatus for supporting a cellular telephone at an elevated position, said retractable tethering apparatus comprising:

a housing;

a spring-actuated spool positioned within the housing;

a flexible cord retractably wound about said spring-actuated spool;

a coupling section secured to a distal end of said cord and adapted to be connected to the cellular telephone; and means for automatically notifying the user when said coupling section is disengaged from said housing by emitting an alert signal when said cord is unwound from a retracted position;

wherein said coupling section comprises:

a ring adapted to be directly connected to the cellular telephone; and a bracket adjustably mated directly to said ring, said bracket being adapted to remain spaced from the cellular telephone such that said ring remains freely adjustable with said bracket, said bracket being provided with laterally registered ribs linearly extending along opposed faces of said bracket;

wherein said housing comprises a notch formed at a distal end thereof, said notch passing from an anterior face of said housing to a posterior face thereof, said bracket being countersunk within said notch while attached to said housing such that said cord is maintained at a maximum wound position while said bracket is coupled to said housing;

wherein said housing further comprises:

a plurality of oppositely spaced rectilinear grooves formed within said notch and extending from said anterior face to said posterior face of said housing respectively, said ribs being contiguously interfitted within said grooves while said bracket is seated within said notch; and a plurality of opposed recessions formed along said distal end of said housing, said recessions laterally extending away from said notch and being equidistantly offset from a center of said notch for receiving opposed quadrants of said ring;

wherein said coupling section is maintained at a substantially stable position while said bracket is countersunk within said notch and said opposed ring quadrants are interfitted within said recessions respectively.

2. The retractable tethering apparatus of claim 1, wherein said automatic notifying means comprises:

a sensor located within said housing and communicatively mated to said coupling section;

a transducer located within said housing and communicatively mated to said sensor; and a power source located within said housing and communicatively mated to said transducer;

wherein said sensor generates and transmits first and second output signals to said transducer when said coupling section is detached and attached to said housing respectively;

wherein said transducer automatically generates and emits said alert signal upon receiving said first output signal, said alert signal being automatically discontinued when said transducer receives said second output signal.

3. The retractable tethering apparatus of claim 1, further comprising: a resilient belt clip directly attached to an outer surface of said housing for securing said housing to the user.

4. The retractable tethering apparatus of claim 1, wherein said spring-actuated spool comprises: a spring member statically attached to said spool and being helically wound thereabout, said spring member being tensioned to a compressed position as said spool is rotated in a first direction during a cord extraction procedure, said spring member being automatically returned to an equilibrium position upon completion of said extraction procedure, said spool being caused to automatically rotate along a second direction as said cord is retracted into said housing and wound about said spool.

5. The retractable tethering apparatus of claim 1, wherein said ring is prohibited from being displaced along a travel path defined parallel to said grooves while said opposed quadrants are nested within said recessions.

6. The retractable tethering apparatus of claim 1, wherein said sensor is communicatively coupled to said grooves and thereby detects whether said ribs are contiguously positioned within said grooves, said first and second output signals being automatically generated when said ribs are removed and positioned within said grooves such that said alert signal is automatically emitted when said bracket becomes detached from said notch.

7. A retractable tethering apparatus for supporting a cellular telephone at an elevated position, said retractable tethering apparatus comprising:

a portable housing;

a spring-actuated spool positioned within the housing;

a flexible cord retractably wound about said spring-actuated spool;

a coupling section secured to a distal end of said cord and adapted to be connected to the cellular telephone; and means for automatically notifying the user when said coupling section is disengaged from said housing by emitting an alert signal when said cord is unwound from said spring-actuated spool;

wherein said coupling section is completely disengaged from said housing when said cord is extracted from said housing;

wherein said coupling section comprises:

a ring adapted to be directly connected to the cellular telephone; and a bracket adjustably mated directly to said ring, said bracket being adapted to remain spaced from the cellular telephone such that said ring remains freely adjustable with said bracket, said bracket being provided with laterally registered ribs linearly extending along opposed faces of said bracket;

wherein said housing comprises a notch formed at a distal end thereof, said notch passing from an anterior face of said housing to a posterior face thereof, said bracket being countersunk within said notch while attached to said housing such that said cord is maintained at a maximum wound position while said bracket is coupled to said housing;

wherein said housing further comprises:

a plurality of oppositely spaced rectilinear grooves formed within said notch and extending from said anterior face to said posterior face of said housing respectively, said ribs being contiguously interfitted within said grooves while said bracket is seated within said notch; and a plurality of opposed recessions formed along said distal end of said housing, said recessions laterally extending away from said notch and being equidistantly offset from a center of said notch for receiving opposed quadrants of said ring;

wherein said coupling section is maintained at a substantially stable position while said bracket is countersunk within said notch and said opposed ring quadrants are interfitted within said recessions respectively.

8. The retractable tethering apparatus of claim 7, wherein said automatic notifying means comprises:

a sensor located within said housing and communicatively mated to said coupling section;

a transducer located within said housing and communicatively mated to said sensor; and a power source located within said housing and communicatively mated to said transducer;

wherein said sensor generates and transmits first and second output signals to said transducer when said coupling section is detached and attached to said housing respectively;

wherein said transducer automatically generates and emits said alert signal upon receiving said first output signal, said alert signal being automatically discontinued when said transducer receives said second output signal.

9. The retractable tethering apparatus of claim 7, further comprising: a resilient belt clip directly attached to an outer surface of said housing for securing said housing to the user.

10. The retractable tethering apparatus of claim 7, wherein said spring-actuated spool comprises: a spring member statically attached to said spool and being helically wound thereabout, said spring member being tensioned to a compressed position as said spool is rotated in a first direction during a cord extraction procedure, said spring member being automatically returned to an equilibrium position upon completion of said extraction procedure, said spool being caused to automatically rotate along a second direction as said cord is retracted into said housing and wound about said spool.

11. The retractable tethering apparatus of claim 7, wherein said ring is prohibited from being displaced along a travel path defined parallel to said grooves while said opposed quadrants are nested within said recessions.

12. The retractable tethering apparatus of claim 7, wherein said sensor is communicatively coupled to said grooves and thereby detects whether said ribs are contiguously positioned within said grooves, said first and second output signals being automatically generated when said ribs are removed and positioned within said grooves such that said alert signal is automatically emitted when said bracket becomes detached from said notch.

* * * * *